United States Patent [19]

Vogel

[11] 4,401,140

[45] Aug. 30, 1983

[54] FILLER VALVE FOR VALVE BAG

[75] Inventor: Karl Vogel, Bad Vilbel, Fed. Rep. of Germany

[73] Assignee: Degussa Aktiengesellschaft, Frankfort am Main, Fed. Rep. of Germany

[21] Appl. No.: 315,217

[22] Filed: Oct. 26, 1981

[30] Foreign Application Priority Data

Oct. 28, 1980 [DE] Fed. Rep. of Germany ..... 3040504

[51] Int. Cl.[3] ..... B65B 3/04; B65B 1/04

[52] U.S. Cl. ..... 141/68; 150/9; 229/62.5

[58] Field of Search ..... 229/62.5; 150/9; 141/10, 67, 68, 313–317, 392, 114, 113

[56] References Cited

U.S. PATENT DOCUMENTS 3,894,682 7/1975 Harmsen ..... 229/62.5

*Primary Examiner*—Houston S. Bell, Jr.

*Attorney, Agent, or Firm*—Cushman, Darby & Cushman

[57] ABSTRACT

A valve bag adapted to have a filler nozzle inserted therein for filling the bag with bulk material is provided in its top portion with a filler valve which includes a tube of relatively stiff material extending inwardly from an opening in a wall of the bag. Secured to the inner end of the tube is a valve member in the form of a tube of limp, extremely flexible foil which projects inwardly beyond the end of the tube. The foil tube is normally collapsed to form a closure, but is expanded by insertion of a filler nozzle therethrough.

6 Claims, 12 Drawing Figures

FIG. 3
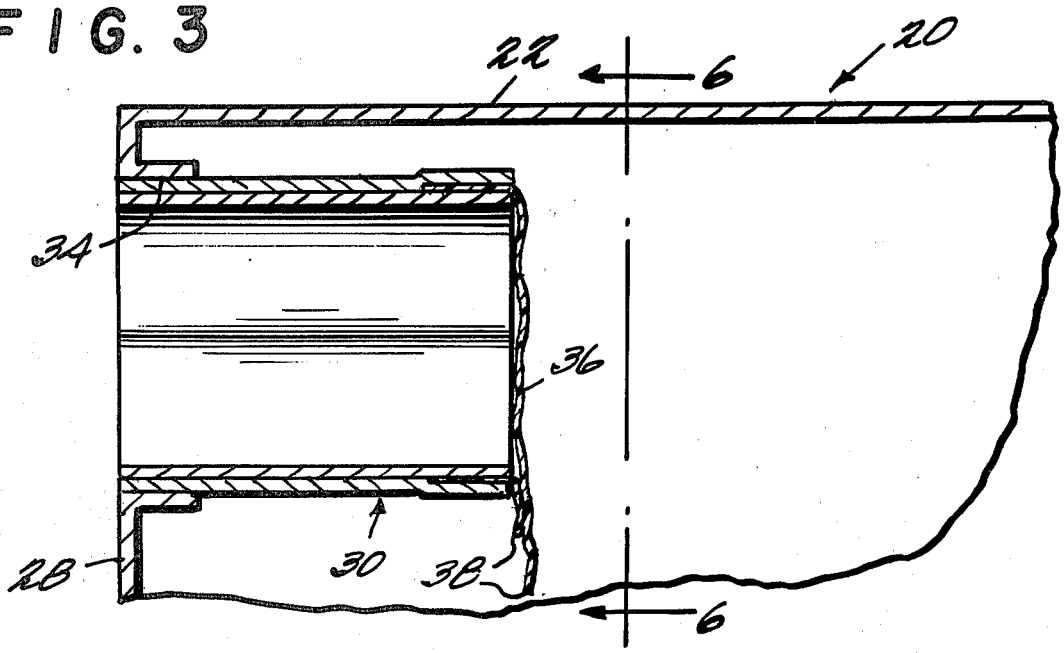
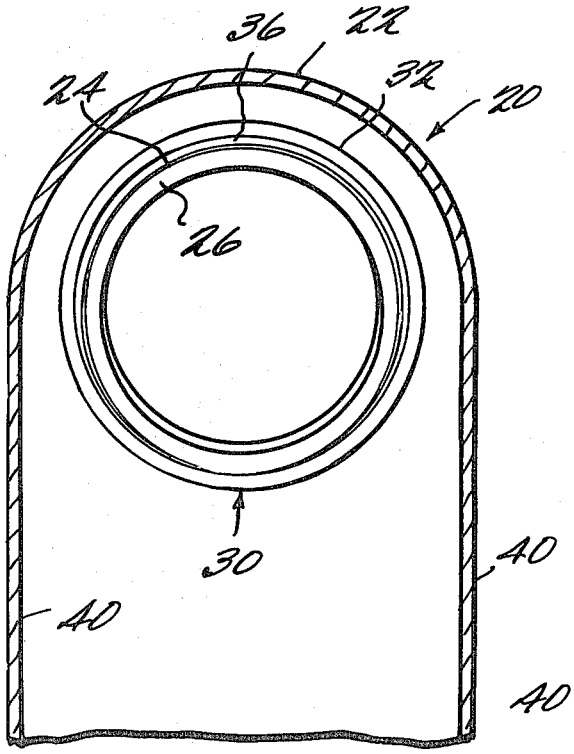
FIG. 4
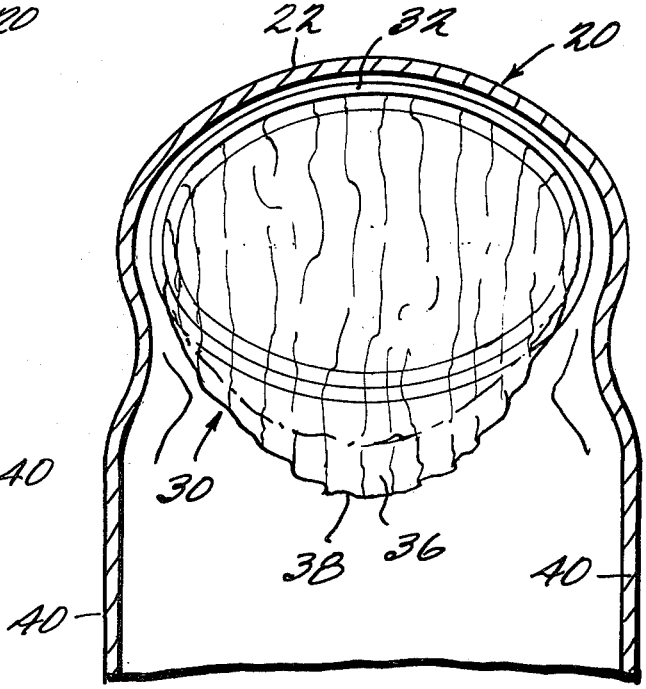
FIG. 6

FIG. 7
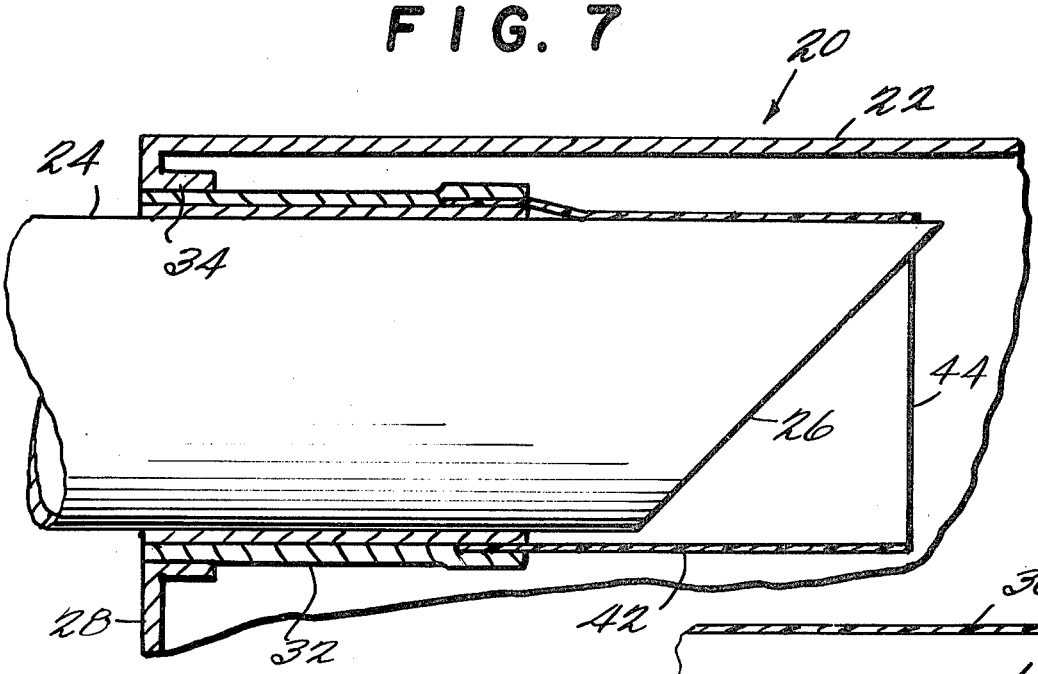
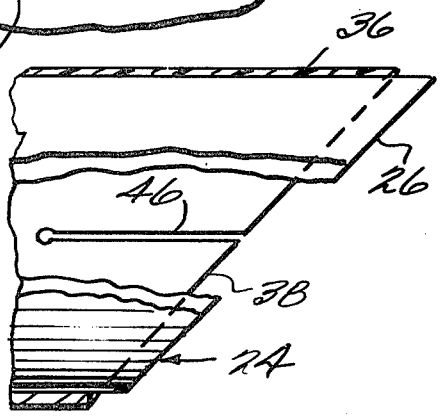
FIG. 9
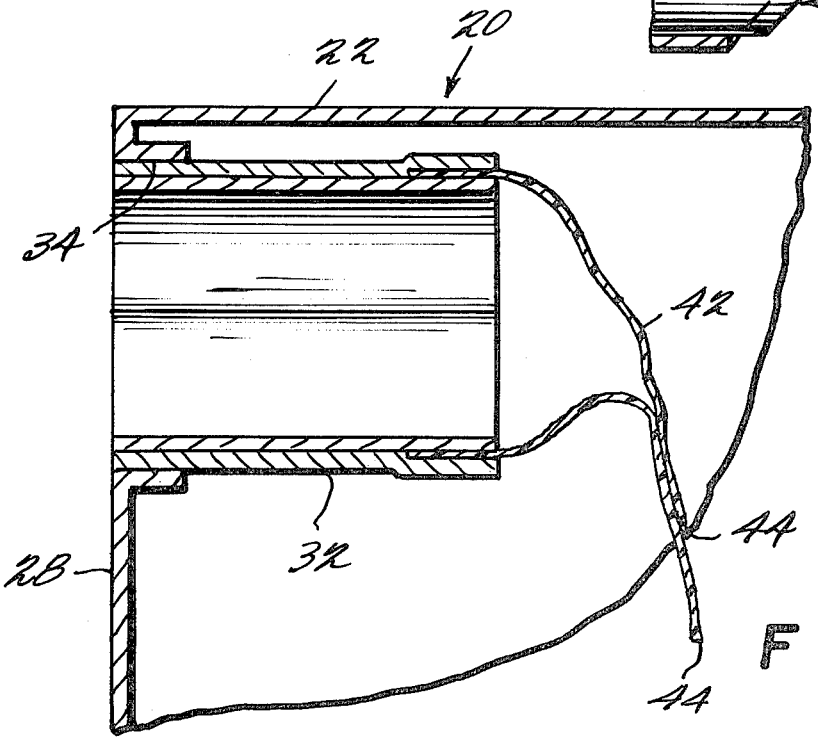
FIG. 8

FIG. 10
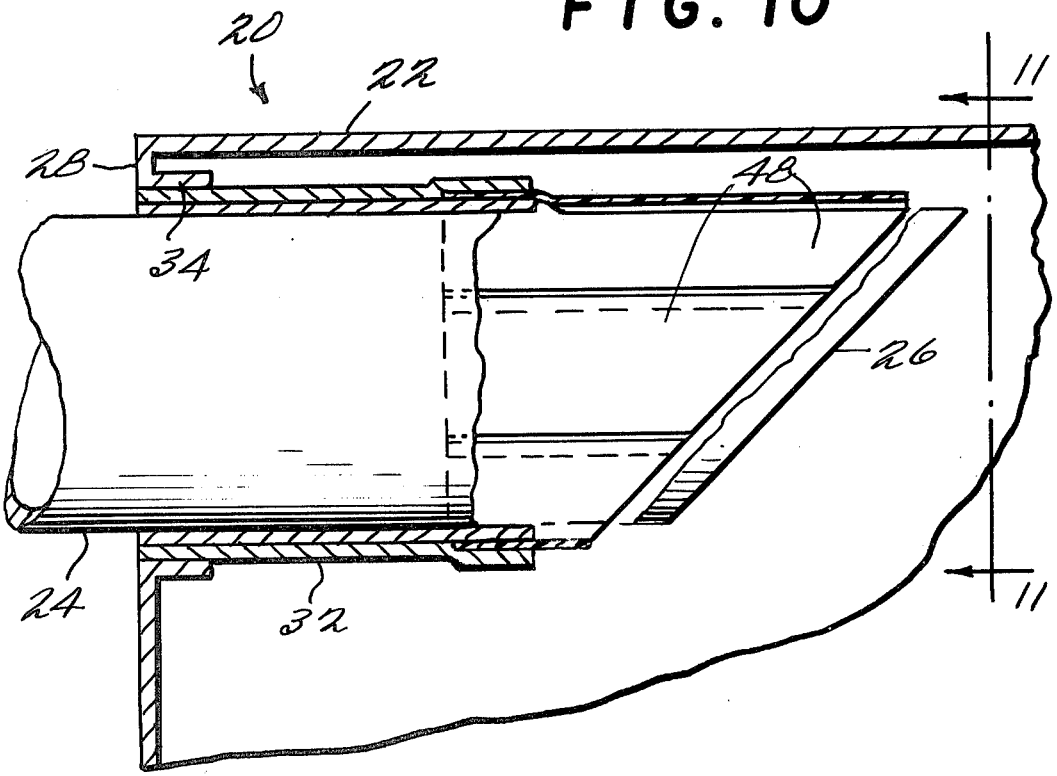
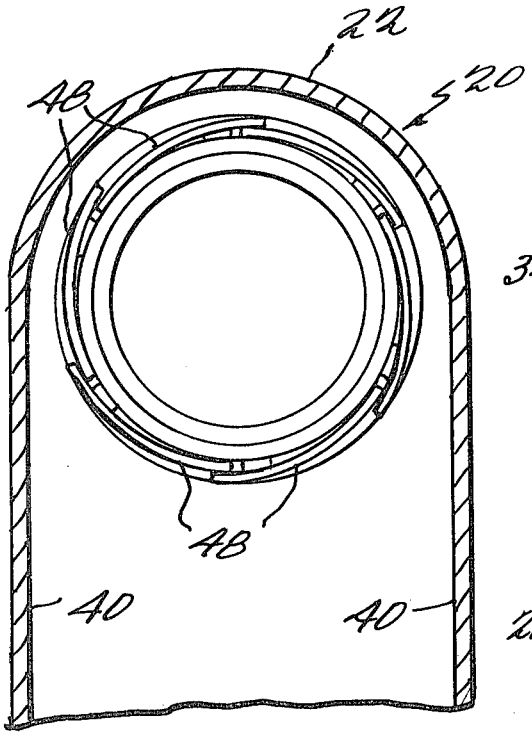
FIG. 11
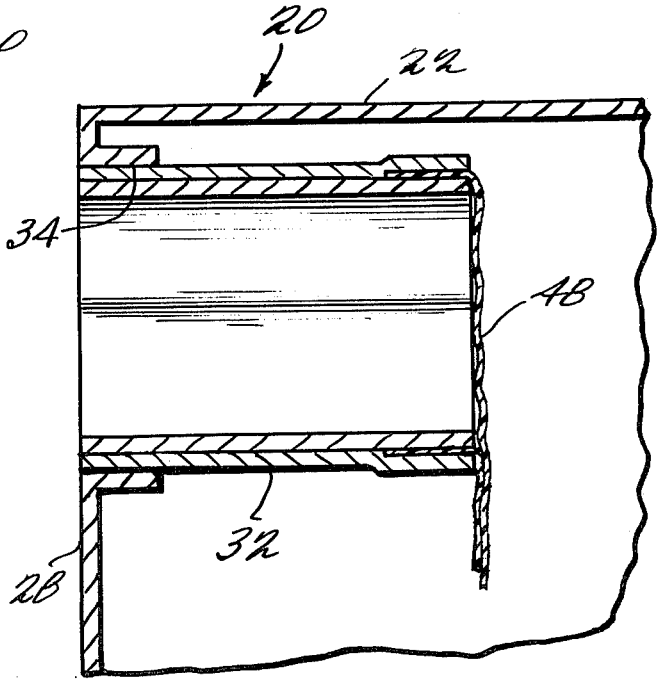
FIG. 12

FILLER VALVE FOR VALVE BAG

FIELD OF THE INVENTION

This invention relates to filler valves for valve bags for bulk material, e.g. powdered, granulated or other finely divided materials. More especially, the invention relates to a simple inexpensive filler valve that provides an effective closure.

BACKGROUND OF THE INVENTION

Powdered, granulated or other finely divided materials, such as carbon black, highly dispersed silica, or foodstuffs, such as flour, are shipped in bags provided with a filler valve which admits insertion of a filler nozzle and closes on withdrawal of the nozzle, i.e., removal of the bag from the filling machine. In most cases such valve bags are made of strong multi-layer paper.

It has been known to make the filler valve likewise of multi-layer relatively stiff paper. Such filler valves, however, have the disadvantage of frequently not closing completely with a consequent undesirable escape of the bag contents through the valve especially during transportation of the bag.

Attempts have been made to construct filler valves for valve bags which effectively prevent escape of the bag contents. An example is disclosed in German Pat. No. 2,363,753 wherein the length of the valve falls short of that of the filler nozzle. That valve, however, now only is relatively complex and costly to make but also requires the use of material more expensive than the multi-layer paper of which valve bags normally are made. Another example of an attempted improvement is disclosed in German Utility Pat. No. 1,870,373 wherein the inner end of the filler valve is provided with a flexible insert intended to close on withdrawal of the filler nozzle. In many cases, however, it does not, i.e. its closing action is unsatisfactory.

BRIEF SUMMARY OF THE INVENTION

Accordingly, it is an object of this invention to provide an improved filler valve for valve bags which not only effectively closes after filling and prevents escape of the bag contents but also is simple in construction and inexpensive to manufacture.

The object is attained by a filler valve in the form of an inlet tube, of relatively stiff material, e.g. multi-layer paper, having attached to the inner end thereof an annular valve member of limp, extremely flexible foil which collapses, on withdrawal of the filler nozzle, and forms an effective closure.

Other objects and advantages of the invention will become apparent from the following description and accompanying drawings in which:

FIG. 3 is a view corresponding to FIG. 1 showing the filler nozzle completely withdrawn from the valve.

FIG. 4 is a fragmentary sectional view taken substantially on line 4—4 of FIG. 1.

FIG. 6 is a fragmentary sectional view taken substantially on line 6—6 of FIG. 3.

FIG. 7 is a view corresponding to FIG. 1 of a modified form of the invention.

FIG. 8 is a view corresponding to FIG. 7 showing the filler nozzle completely withdrawn from the valve.

FIG. 9 is a view corresponding to FIG. 1 of another modified form of the invention.

FIG. 10 is a view corresponding to FIG. 1 of still another modified form of the invention.

FIG. 11 is a fragmentary sectional view taken substantially on line 11—11 of FIG. 10.

FIG. 12 is a view corresponding to FIG. 10 showing the filler nozzle completely withdrawn from the valve.

DETAILED DESCRIPTION OF THE INVENTION

Figure 1:
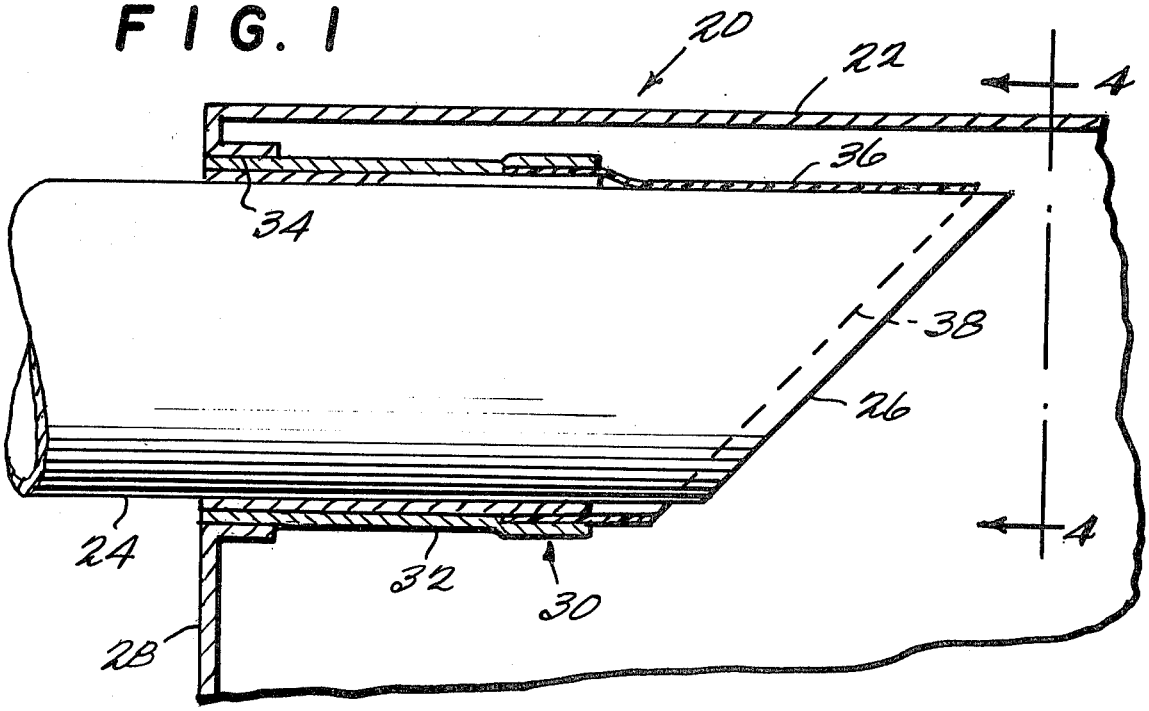
FIG. 1 is a fragmentary longitudinal vertical sectional view through a valve bag equipped with a filler valve embodying this invention. The valve is shown with a filler nozzle inserted therein for filling the bag.

Referring now to the drawings, there is shown a top portion of a valve bag 20 of conventional construction, i.e. made of strong multi-layer paper. The bag 20 is generally rectangular in profile in side and top views and has a closed top 22 that is generally convex when a filling nozzle 24 is inserted into the bag. The filling nozzle 24 of a filling machine (not shown) is usually in the form of a circular tube terminating at its discharge end in an eliptical opening having an edge 26 inclined downward and rearward from the top of the nozzle. The edge 26 may be planar or straight in side profile as shown, or of somewhat concave or dished configuration. Usually the filling machine and nozzle 24 are fixed so that the filling valve of a valve bag to be filled is slipped over the nozzle, and the filled bag pulled off the nozzle.

Fitted into the top portion of the bag 20 at one end 28 thereof is a filler valve 30 embodying this invention. The valve 30 includes a tube 32 of relatively stiff material, such as two plies of strong paper. The tube 32 is circular in transverse section and of a diameter only slightly greater than that of the nozzle 24 in order to receive the latter easily while inhibiting escape of the bulk material being filled through the annular gap between the tube and the nozzle. At its outer end the tube 32 is secured appropriately, as by gluing, to the marginal edge portion of a circular opening 34 in the end wall 28 of the bag 20, and projects therefrom horizontally interiorly into the top portion of the bag.

Suitably secured to the inner end of the tube 32, as by being glued between the plies thereof or within and to the inner ply or over and to the outer ply, is a valve closure member 36 of limp extremely flexible film. As shown in the drawings the member 36 may be of circular tubular configuration, the same as the tube 32, and projects beyond the inner end thereof. The inner end of the valve member 36, when fully expanded, terminates in an eliptical opening having an edge 38 inclined downward and rearward from the top of the member 36 similar to the inclination of the forward end edge 26 of the filler nozzle 24. The top edge portion of the opening in the valve member 36 is located forward beyond the bottom edge portion a distance preferably greater than the diameter of the tube 32 and the member 36 for reasons later explained. Further the bottom edge portion of the opening in the member 36 is located some distance beyond the inner end of the tube 32, as shown in FIG. 1.

With the foregoing construction it will be seen that the valve tube 32 facilitates initial insertion of the filling nozzle 24 into the filling valve 30 even though the tube may be partially collapsed in an empty bag. Continued insertion of the nozzle 24 readily expands the valve member 36 from a collapsed condition and allows projection of the nozzle completely through the valve 30 to the filling position shown in FIG. 1.

Figure 2:
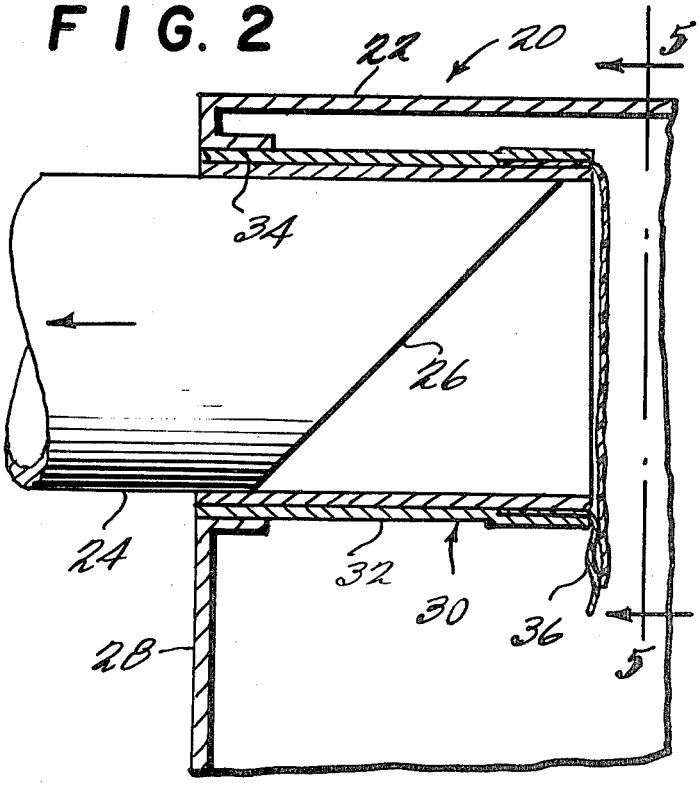
FIG. 2 is a view corresponding to FIG. 1 showing the filler nozzle partially withdrawn from the valve.
Figure 5:
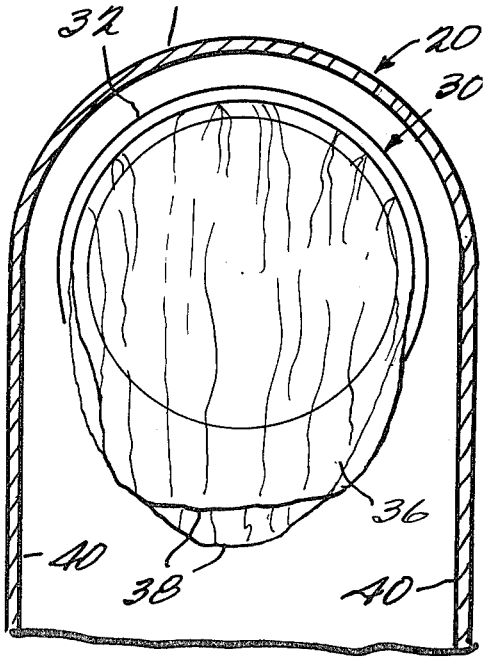
FIG. 5 is a fragmentary sectional view taken substantially on line 5—5 of FIG. 2.

After the bag 20 is filled and the nozzle 24 is withdrawn partially from the valve 30, i.e. from the valve member 36 into the tube 32 as shown in FIG. 2, the valve member, because of its extreme flexibility and limpness, will collapse. On such collapse, the upper portion of the valve member 36 will fall down and, because of its forward projection well beyond the lower portion, will overlap the likewise fallen lower portion, as shown in FIG. 2. This forms an effective closure to prevent escape of any of the contents of the filled bag 20. Complete withdrawal of the filling nozzle 24 from the valve 30, as shown in FIG. 3, results in at least a partial collapse of the entire valve 30, including the tube 32, in a vertical direction because the pressure of the contents of the filled bag 20 outwardly against its side walls 40 tends to spread such walls apart and flatten the top 22 of the bag with a resulting at least partial collapse of the entire valve. Such collapse further enhances the closure of the valve 22 against escape of any of the contents of the filled bag 20.

The limp film forming the valve member 36 may be made of strong tissue paper, polyvinylchloride, polyethylene and other appropriate materials. A particular advantage is had in making the valve member on a self-adhering film, such as vinylidine chloridevinyl chloride, vinylidine chlorideacrylonitrile or polypropylene. In that event the adherence to each other of portions of the inner surfaces of the valve member when partially collapsed in an empty unfilled bag will not prevent expansion of the valve member by insertion of the filling nozzle 24 into the valve. On the other hand, the adherence of the collapsed upper portion of the valve member, on withdrawal of the filling nozzle, to the overlapped lower portion will enhance the closure of the valve member against escape of any of the contents of the filled bag. When the valve member is made of a self-adhering film, it is not essential that the upper portion of the forward end project beyond the lower portion, as shown in FIG. 1. In fact, the inner end of the member 42 may terminate in an edge 44 located in a transverse plane normal to the axis of the tube 32, as shown in FIG. 7. Collapse of such a valve member 42 construction, on withdrawal of the filler nozzle as shown in FIG. 8, results in adherence of large inner surface areas of the member to each other to form an effective closure. To effect this desired result, the valve member 42 should project beyond the tube 32 a distance preferably at least as great as the diameter of the tube.

Complete collapse of the valve member 36 for even more effective closing may be facilitated by longitudinal slits 46 extending rearward from the edge 38 of the opening along diametric opposite sides of the member 36 about midway of its top and bottom, as shown in FIG. 9. The tubular valve member could also be made in a plurality of separate longitudinal sections 48 having overlapping side edges, as shown in FIGS. 10 and 11. Such a construction also would facilitate collapse into an effective closure, as shown in FIG. 12.

It is not, of course, essential that both plies or layers of the tube 32 extend to the inner end thereof. Either the outer or the inner layer may terminate short of the inner end, with the valve member still being appropriately secured over or within the longer layer, or between the two layers.

It thus will be seen that the objects and advantages of this invention have been fully and effectively achieved. It will be realized, however, that the foregoing specific embodiments have been disclosed only for the purpose of illustrating the principles of this invention and are susceptible of modification without departing from such principles. Accordingly, the invention includes all embodiments encompassed within the spirit and scope of the following claims.

What is claimed is:

1. A filler valve for a valve bag adapted to have a filler nozzle inserted therein for filling the bag with bulk material comprising:

a tube of relatively stiff material adapted to have one end secured to the edge of an opening in a wall of the bag immediately below the top thereof and to project into the bag; and a valve member comprising tube means of limp extremely flexible foil having one end thereof secured to the inner end of said tube of relatively stiff material and projecting therebeyond, whereby said foil tube means is normally collapsed to form a closure but is expandable by insertion of a filler nozzle into said valve.

2. The structure defined in claim 1 wherein the tube of relatively stiff material is formed of multiple-ply relatively stiff paper.

3. The structure defined in claim 1, wherein the upper portion of the forward end of the foil tube means projects beyond the lower portion a distance to allow overlapping of said lower portion by said upper portion on collapse of said foil tube means.

4. The structure defined in claim 1 wherein the foil is made of self-adhering material.

5. The structure defined in claim 1 wherein the foil tube means is made in a plurality of separate longitudinal sections having overlapping side edges.

6. The structure defined in claim 1 wherein the foil tube means has longitudinal slits therein extending rearward from the forward edge thereof to facilitate the collapse thereof.

* * * * *